US005323215A

United States Patent [19]

Ohtaka et al.

[11] Patent Number: 5,323,215

[45] Date of Patent: Jun. 21, 1994

[54] CHARGING MEMBERS FOR CHARGING A PHOTOSENSITIVE BODY WITHOUT REMOVING USED TONER FROM THE BODY

[75] Inventors: Yoshimitsu Ohtaka, Shizuoka; Mitsuharu Endou, Susono, both of Japan

[73] Assignee: Tokyo Electric Co., Ltd., Tokyo, Japan

[21] Appl. No.: 861,931

[22] Filed: Apr. 2, 1992

[30] Foreign Application Priority Data

Apr. 10, 1991 [JP] Japan ..... 3-077929

[51] Int. Cl.[5] ..... G03G 15/06

[52] U.S. Cl. ..... 355/269; 118/652; 355/219; 355/270; 355/296

[58] Field of Search ..... 355/219, 273, 271, 275, 355/281, 245, 296, 270, 269; 361/212, 221, 225; 118/652

[56] References Cited

U.S. PATENT DOCUMENTS 3,764,207 10/1973 Obuchi ..... 355/219
4,756,992 7/1988 Cheng ..... 355/219 X
4,959,688 9/1990 Koitabashi .
5,066,982 11/1991 Hosoya et al. ..... 355/296 X
5,103,265 4/1992 Kohyama ..... 355/245 X

FOREIGN PATENT DOCUMENTS 56-91253 7/1981 Japan .
56-104346A 8/1981 Japan .
58-139156A 8/1983 Japan .
62-29789 6/1987 Japan .
62-49625 10/1987 Japan .
63-149669 6/1988 Japan .

*Primary Examiner*—A. T. Grimley
*Assistant Examiner*—Shuk Y. Lee
*Attorney, Agent, or Firm*—Frishauf, Holtz, Goodman & Woodward

[57] ABSTRACT

A rotating photosensitive body has a plurality of charging members on its surface. A direct voltage whose polarity is opposite to the charging polarity of the photosensitive body is applied to at least one of the charging members, and a direct voltage whose polarity is equal to the charging polarity thereof is applied to at least one of the other charging members.

26 Claims, 7 Drawing Sheets

CHARGING MEMBERS FOR CHARGING A PHOTOSENSITIVE BODY WITHOUT REMOVING USED TONER FROM THE BODY

BACKGROUND OF THE INVENTION

1. Field of the Invention

The present invention relates to a method and a device for charging a photosensitive body in contact with a charging member in an electrophotographic apparatus such as a laser printer and a copying machine.

2. Description of the Related Art

An electrophotographic apparatus, for example, a laser printer includes a charging device, an exposure device having a laser beam emitter, a developing device, and a transfer device which are arranged around a photosensitive body. In the laser printer, when printing is performed, the charging device is operated to uniformly charge the photosensitive body, and then the exposure device is operated to scan the photosensitive body with a laser beam having recording information, thereby forming an electrostatic latent image thereon. After this, the developing device is operated to stick the toner on the electrostatic latent image, and the transfer device is operated to transfer a toner image formed by the operation of the developing device onto paper.

There are two methods for charging the photosensitive body using the charging device of the laser printer. The first method is executed by corona discharge caused by a scorotron, and the second method is executed by bringing a member such as a charging roller, a charging brush, and a charging blade into contact with the photosensitive body.

The first method requires a high voltage power supply of 5 to 10 KV and generates a great deal of ozone due to the corona discharge. The ozone degrades the material characteristics of the photosensitive body. To solve this problem, the first charging method is being replaced with the second method. The second charging method has the advantage of requiring a relatively low voltage power supply and greatly reducing the ozone.

The second charging method is disclosed in Published Unexamined Japanese Patent Application No. 56-91253. According to the second charging method, as shown in FIG. 6, first, second, and third charging rolers 2*a*, 2*b*, and 2*c* are arrange on a photosensitive drum 1 in contact with each other in the moving direction of the photosensitive drum (in the direction of arrow). As shown in FIG. 7, the charging rollers 2*a*, 2*b*, and 2*c* superimpose an alternating voltage on direct voltages of 200V, 350V, and 500V, respectively. The peak-to-peak value of the alternating voltage is 20% of each of the direct voltages. The voltages obtained by the superimposition are sequentially applied to the surface of the photosensitive drum 1. The potential of the surface of the photosensitive drum 1 gradually increases, and finally it is charged with a voltage of 500V necessary for exposure.

In the second charging method, however, since the direct and alternating voltages are applied to the charging rollers 2*a*, 2*b*, and 2*c*, two power supplies, i.e., direct and alternating power supplies are required, thus complicating an arrangement of the power supplies.

SUMMARY OF THE INVENTION

It is accordingly an object of the present invention to provide a method and a device for charging the surface of a photosensitive body at a uniform potential by bringing a charging member into contact with the photosensitive body, in which a power supply necessary for the charge is simple in arrangement.

According to one aspect of the present invention, there is provided a method for charging a photosensitive body in contact with a charging member, comprising the steps of:

applying a direct voltage whose polarity is opposite to a charging polarity of the photosensitive body; and applying a direct voltage whose polarity is equal to the charging polarity of the photosensitive body.

According to another aspect of the present invention, there is provided a device for charging a photosensitive body, comprising:

a plurality of charging means for charging the photosensitive body in contact with a surface of the photosensitive body which rotates;

first applying means for applying a direct voltage whose polarity is opposite to a charging polarity of the photosensitive body, to at least one of the plurality of charging means; and second applying means for applying a direct voltage whose polarity is equal to the charging polarity of the photosensitive body, to at least one of the plurality of charging means other than the charging means to which the direct voltage is applied by the first applying means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
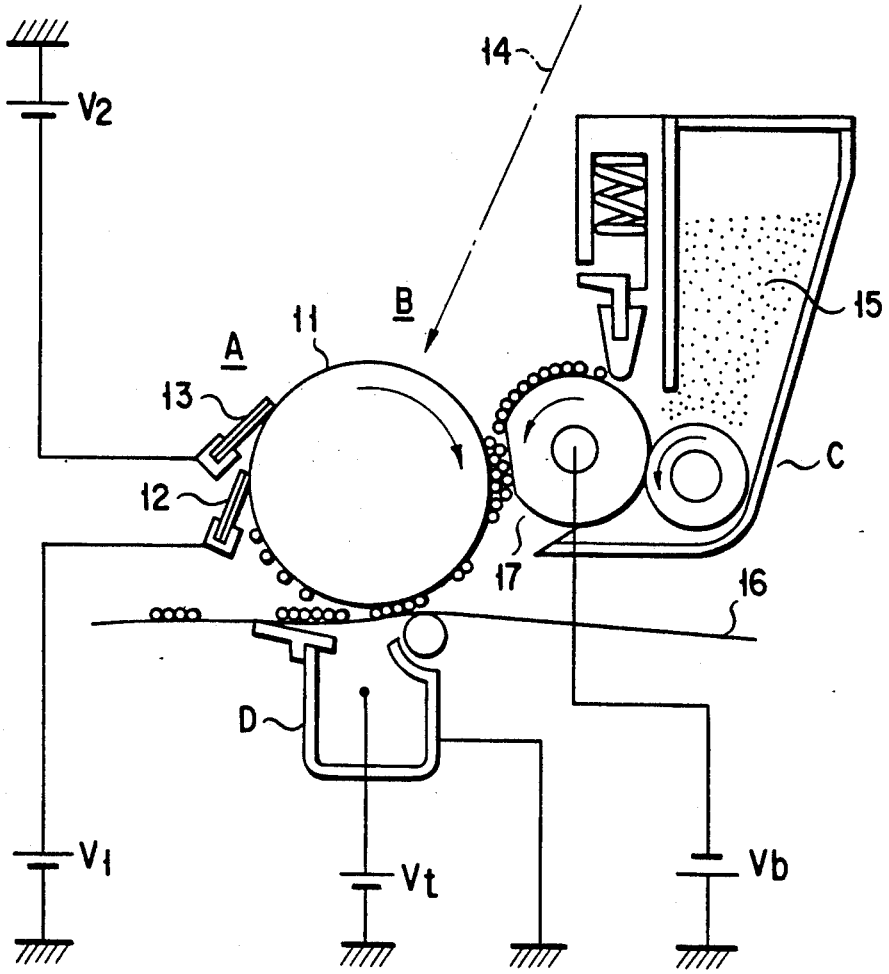
FIG. 1 is a view of an arrangement of the main part of a charging device according to an embodiment of the present invention.

FIG. 1 shows a charging device according to an embodiment of the present invention, which is applied to a laser printer. A drum type photosensitive body 11 rotates in the direction of the arrow, i.e., clockwise. First and second conductive brushes 12 and 13 are arranged with their ends in contact with the surface of the photosensitive body 11. The second conductive brush 13 is arranged after the first conductive brush 1 in the rotating direction of the photosensitive body 11. These conductive brushes 12 and 13 can be replaced with a conductive cloth, a conductive roller, a conductive rubber blade, a conductive sponge, or the like. The first and second conductive brushes constitute a charging device A.

The laser printer further includes an exposure device B, a developing device C, and a transfer device D which are arranged around the photosensitive body 11.

The exposure device B emits a laser beam onto the surface of the photosensitive body 11 charged by the charging device A to expose it, thereby recording image information in the form of an electrostatic latent image. In the developing device C, toner 15 is stuck to the electrostatic latent image formed by the exposure device B, thereby performing a developing operation. The transfer device D transfers a toner image formed by the developing device C to paper 16. The paper 16 is fed from a paper feeding device (not shown) in predetermined timing. The developing device C includes a developing roller 17. When the developing roller 17 rotates in the direction of the arrow shown in FIG. 1, the developing device C transmits the toner 15 to the surface of the photosensitive body 11. The transmitted toner 15 is stuck to the surface of the photosensitive body 11. A direct voltage V1 whose polarity is opposite to the charging polarity of the photosensitive body 11 is applied to the first conductive brush 12, and a direct voltage V2 whose polarity is equal to the charging polarity of the photosensitive body 11 is applied to the second conductive brush 13. A transfer voltage Vt is applied to the transfer device D. A development bias voltage Vb is applied to the developing roller 17. The direct voltages V1 and V2 are set to, for example, +500V and −1100V, respectively. More specifically, the direct voltage V1 is set to +500V substantially equal to a charge starting voltage between the first conductive brush 12 and photosensitive body 11 since the photosensitive body is degraded by discharge if the direct voltage V1 exceeds the charge starting voltage. The direct voltage V1 is therefore set to +500V which is substantially the same as the charge starting voltage.

Figure 2:
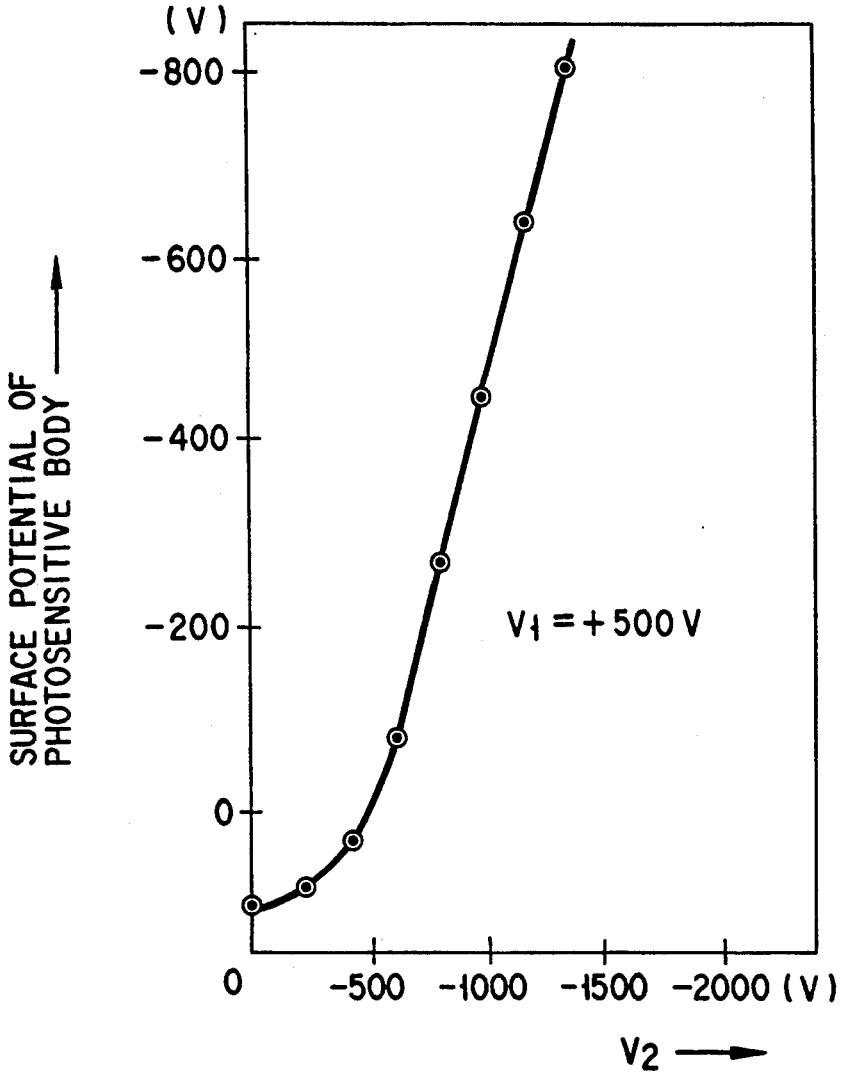
FIG. 2 is a graph showing a relationship between a voltage applied to each conductive brush and a potential of the surface of a photosensitive body in the charging device shown in FIG. 1.

The direct voltage V2 is set so that the surface of the photosensitive body 11 has a predetermined charging potential. FIG. 2 is a graph showing a relationship between the surface potential of the photosensitive body 11 and the direct voltage V2 when the direct voltage V1 is set to, for example, +500V. As is apparent from FIG. 2, if the charging potential of the photosensitive body 11 is −500V, the direct voltage V2 is set to −1100V.

An operation of the charging device according to the above embodiment of the present invention will be described.

The photosensitive body 11 rotates clockwise in FIG. 1 and is charged by the charging device A. An electrostatic latent image is formed on the photosensitive body 11 by the exposure device B based on image information. Toner is stuck to the electrostatic latent image by the developing device C to form a toner image on the photosensitive body 11, and the toner image is transferred to the paper 16 by the transfer device D. In this case, part of toner remains on the surface of the photosensitive body 11, and the remaining toner is positively and negatively charged.

If the photosensitive body 11 is next charged only by a conductive brush whose polarity is, for example negative when the positively and negatively charged toner remains thereon in the form of a lump, it cannot be uniformly charged. To solve this problem, a voltage (V1=+500V) whose polarity is opposite to the charging polarity of the photosensitive body 11 is applied from the first conductive brush 12 to the surface of the photosensitive body 11. Therefore, all the remaining toner on the surface of the photosensitive body is positively charged. A voltage (V2=−1100V) whose polarity is equal to the charging polarity of the photosensitive body 11 is applied from the second conductive brush 13 to the surface of the photosensitive body 11. Therefore, the surface of the photosensitive body 11 is charged to have a predetermined charging potential of −500V.

Figure 1A:
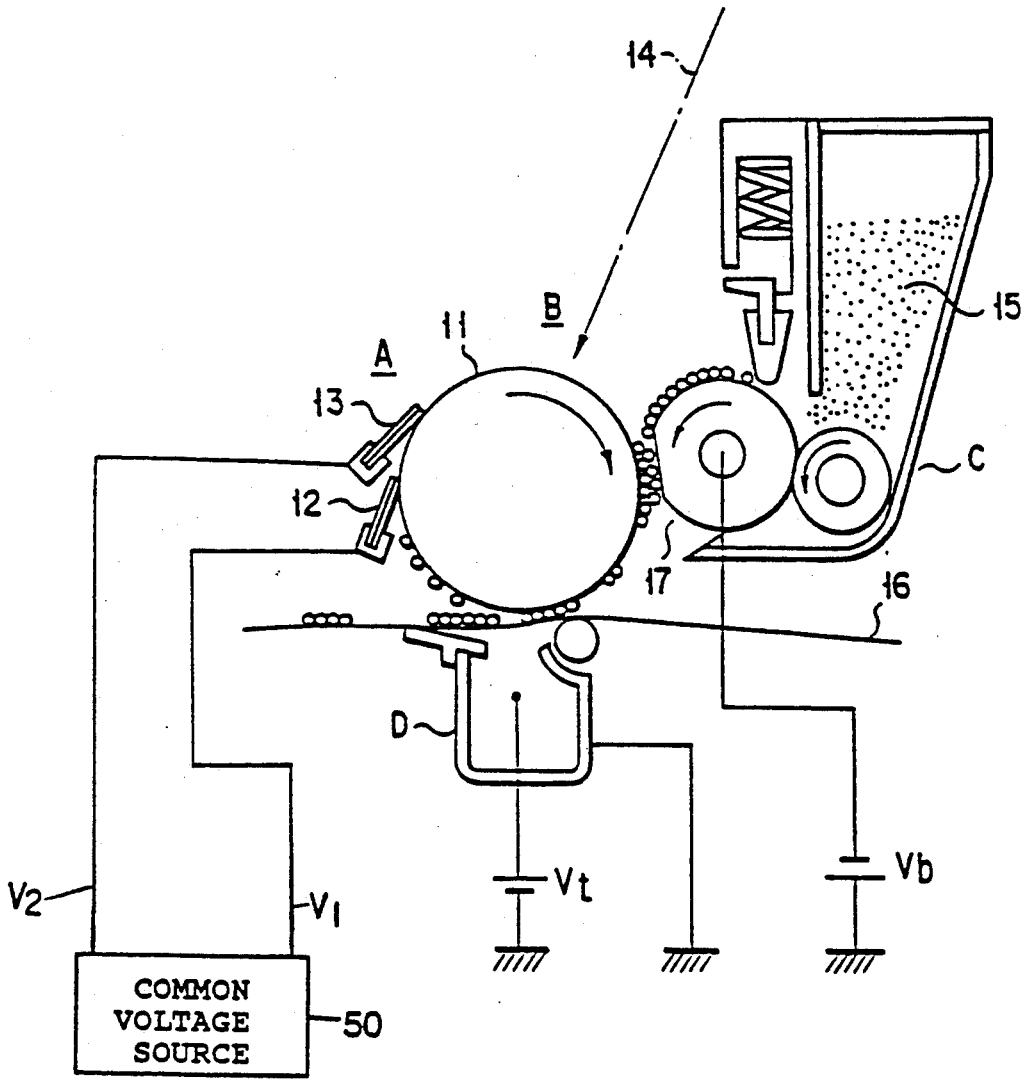
FIG. 1A is identical to FIG. 1 except that in FIG. 1A voltages V1 and V2 are provided by a common voltage source.

The direct voltages V1 and V2 are sufficient for the voltage used in the charging device A, and the direct voltages V1 and V2 can be extracted from a common direct power supply 50 as shown in FIG. 1A. The number of power supplies required for charging the photosensitive body is thus one, resulting in simplification of power supply arrangement and reduction in cost.

Since the first and second conductive brushes 12 and 13 have a function of reducing the density of the remaining toner to uniform the toner, it is unnecessary to arrange a cleaning device exclusively for removing the remaining toner.

Figure 3:
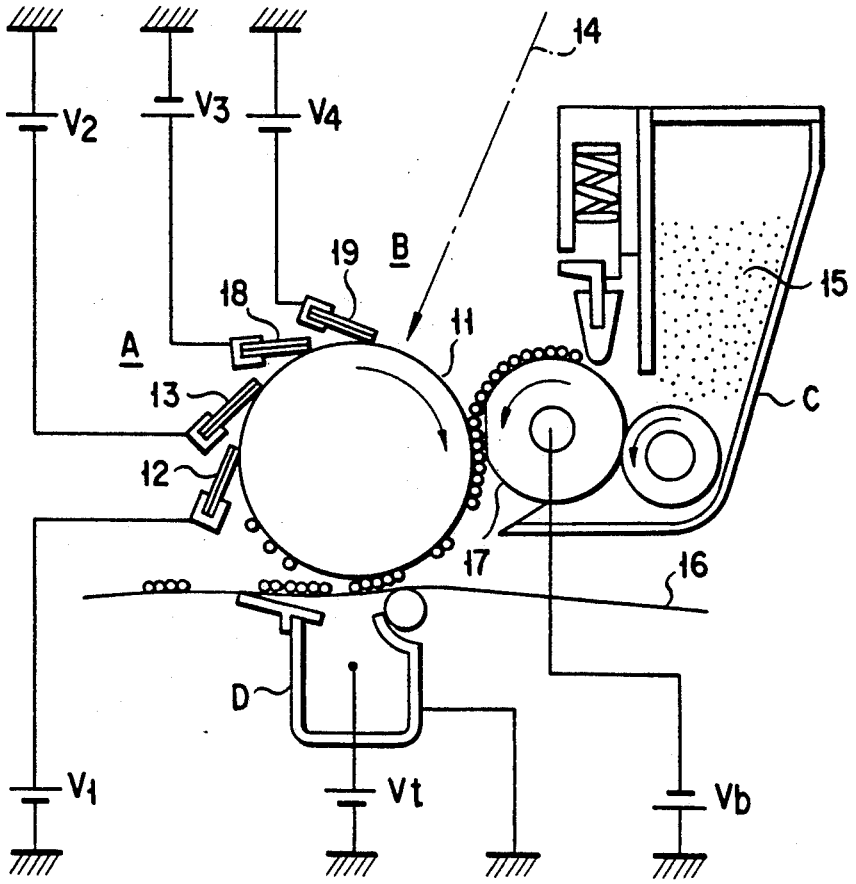
FIG. 3 is a view of an arrangement of the main part of a charging device according to another embodiment of the present invention.

FIG. 3 shows a charging device according to another embodiment of the present invention, which is applied to a laser printer.

Like the first and second conductive brushes 12 and 13, third and fourth conductive brushes 18 and 19 are arranged with their ends in contact with the surface of the photosensitive body 11. These first to fourth conductive brushes 12, 13, 18, and 19 constitute the charging device A. The third conductive brush 18 is arranged after the second conductive brush 13 in the rotating direction of the photosensitive body 11, and the fourth conductive brush 19 is arranged after the third conductive brush 18 in the rotating direction of the photosensitive body 11.

Direct voltages V1 of +500V and V2 of −1100V are applied to the first and second conductive brushes 12 and 13, respectively, as in the embodiment shown in FIG. 1. A direct voltage V3 whose value ranges from 0 to 10V is applied to the third conductive brush 18, and a direct voltage V4 of −1100V is applied to the fourth conductive brush 19.

Figure 3A:
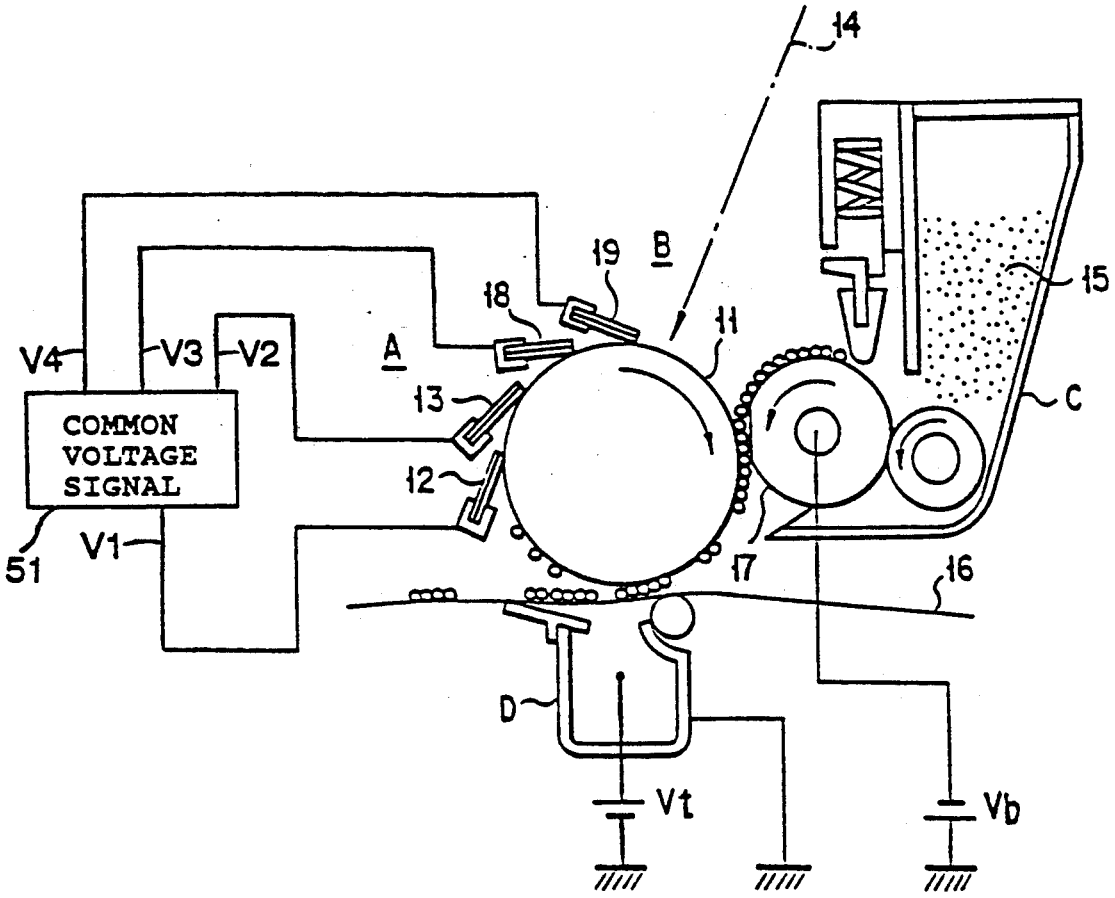
FIG. 3A is identical to FIG. 3 except that in FIG. 3A voltages V1, V2, V3 and V4 are provided by a common voltage source.

FIG. 3A shows that a common voltage source 51 provides voltages V1, V2, V3 and V4 shown in FIG. 3.

Figure 4A:
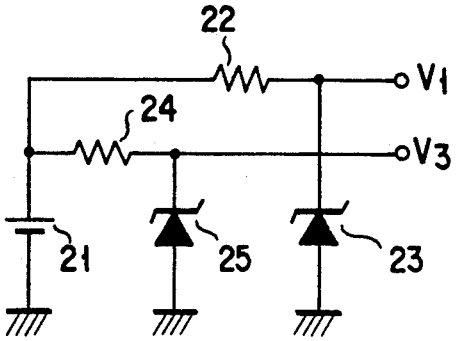
FIGS. 4A and 4B are circuit diagrams showing the structures of direct power supplies of the charging device shown in FIG. 3.

The direct voltage V1 of +500V and the direct voltage V3 of, e.g., +10V are extracted from the power supply circuit shown in FIG. 4A. In this power supply circuit, a reference diode 23 is connected in parallel to a direct power supply 21 of +550V through a resistor 22, and a reference diode 25 is connected in parallel to the direct power supply 21 through a resistor 24. The direct voltage V1 is extracted from both ends of the reference diode 23, and the direct voltage V3 is extracted from both ends of the reference diode 25.

Figure 4B:
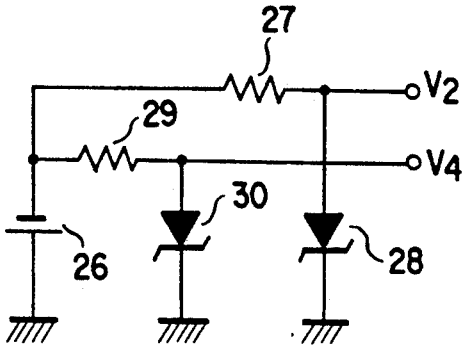

The direct voltage V2 of −1100V and the direct voltage V4 of −500V are extracted from the power supply circuit shown in FIG. 4B. In this power supply circuit, a reference diode 28 is connected in parallel to a direct power supply 26 of −1200V through a resistor 27, and a reference diode 30 is connected in parallel to the direct power supply 26 through a resistor 29. The direct voltage V2 is extracted from both ends of the reference diode 28, and the direct voltage V4 is extracted from both ends of the constant voltage diode 30.

An operation of the charging device according to the above embodiment shown in FIG. 3 will be described.

Figure 5A:
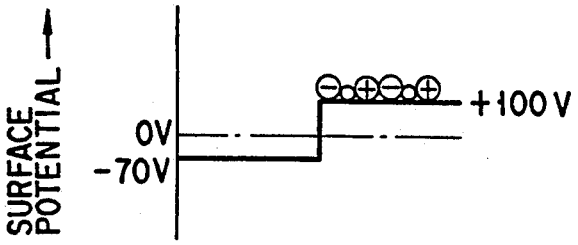
FIGS. 5A, 5B, 5C, 5D, 5E, 5F, and 5G are graphs each showing a variation in the potential of the surface of a photosensitive body due to an operation of the charging device shown in FIG. 3.

The photosensitive body 11 rotates clockwise in FIG. 3 and is charged by the charging device A. An electrostatic latent image is formed on the photosensitive body 11 by the exposure device B based on image information. Toner is stuck to the electrostatic latent image by the developing device C to form a toner image on the photosensitive body 11, and the toner image is transferred to the paper 16 by the transfer device D. In this case, part of toner remains on the surface of the photosensitive body 11, and the remaining toner is positively and negatively charged. The surface potential of the photosensitive body 11 is shown in FIG. 5A.

Figure 5E:
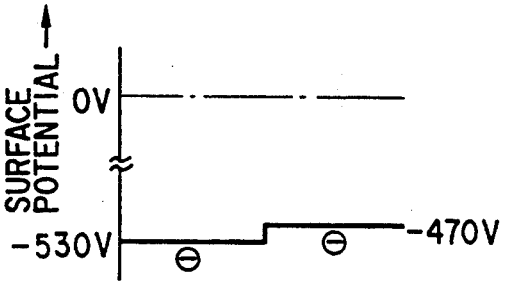
Figure 5B:
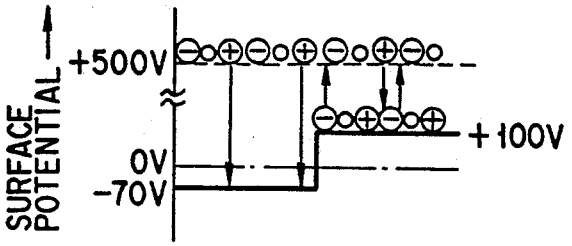
Figure 5F:
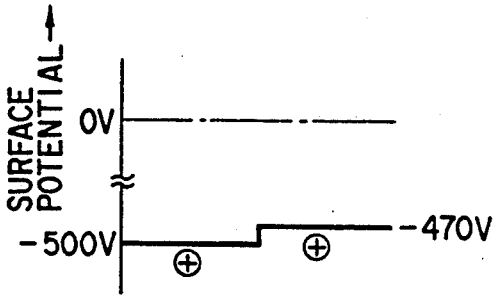
Figure 5C:
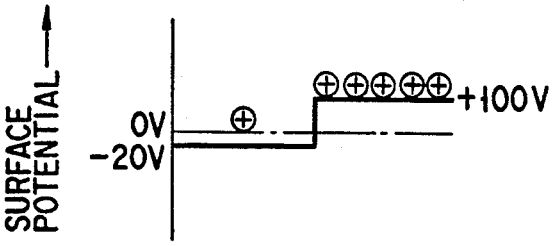

The photosensitive body 11 further rotates and the remaining toner reaches the first conductive brush 12. The direct voltage of +500V is applied to the first conductive brush 12, as indicated by a dotted line in FIG. 5B. The surface potential of the photosensitive body 11 is changed by the conductive brush 12 as shown in FIG. 5C. All the remaining toner is charged positively.

The photosensitive body 11 further rotates and the remaining toner reaches the second conductive brush 13. The direct voltage of −1100V is applied to the second conductive brush 13, as indicated by a dotted line in FIG. 5D. The toner positively charged on the photosensitive body 11 is absorbed by the second conductive brush 13, and the toner absorbed and negatively charged by the second conductive brush 3 is then absorbed by the photosensitive body 11. The surface potential of the photosensitive body 11 varies from −470V to −530V by the second conductive brush 13, as shown in FIG. 5E.

The photosensitive body 11 further rotates and the remaining toner reaches the third conductive brush 18. The direct voltage of +10V is applied to the third conductive brush 18. The surface potential of the photosensitive body 11 is changed to around −500V by the third conductive brush 18, as shown in FIG. 5F.

Figure 5G:
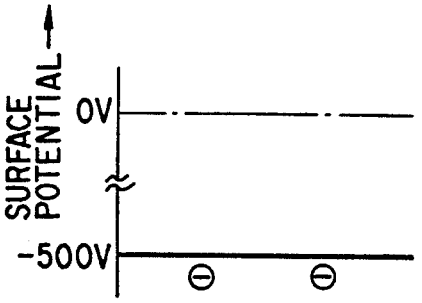
Figure 5D:
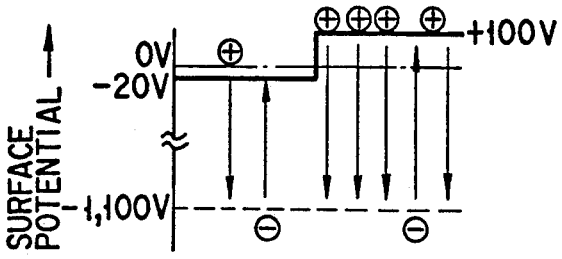
Figure 6:
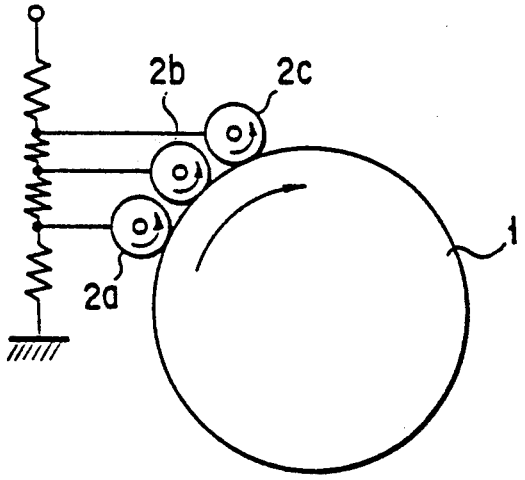
F I G. 6 (PRIOR ART)
FIG. 6 is a view of a conventional charging device.
Figure 7:
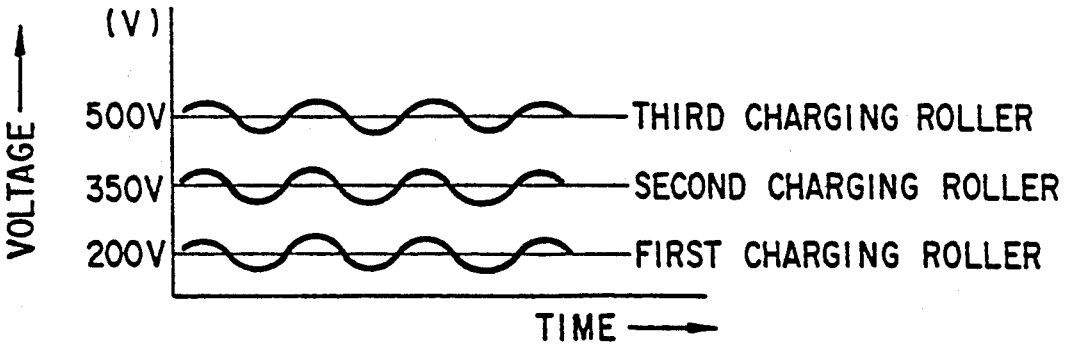
F I G. 7 (PRIOR ART)
FIG. 7 is a graph showing waveforms of voltages applied to charging rollers of the conventional charging device.

The photosensitive body 11 further rotates and the remaining toner reaches the fourth conductive brush 19. The direct voltage of −1100V is applied to the fourth conductive brush 19. The surface potential of the photosensitive body 11 is changed to −500V by the fourth conductive brush 19, as shown in FIG. 5G, and the photosensitive body is charged in substantially uniform fashion.

Finally the photosensitive body 11 is uniformly charged at its surface potential of −500V.

The direct voltage V1 of +500V and the direct voltage of V3 of +10V can be generated from the power supply circuit shown in FIG. 4A, and the direct voltage V2 of −1100V and the direct voltage V4 of −500V can be generated from the power supply circuit shown in FIG. 4B. The direct power supplies 21 and 26 can be obtained from a single direct power supply. In the embodiment shown in FIG. 3, the number of power supplies required for charging the photosensitive body is also one, resulting in simplification of power supply arrangement and reduction in cost.

If three or more conductive brushes are arranged, the first one of them does not have to have a polarity opposite to the polarity of the photosensitive body 11. Even though the polarity of the first conductive brush is the same as that of the photosensitive body, the surface potential of the photosensitive body can be uniformly charged.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An electrophotographic apparatus without a cleaning apparatus for cleaning used toner from a rotatable photosensitive body which is rotatable in a given direction, comprising:

exposing means for exposing and attenuating part of a charge on a surface of said photosensitive body, to form an electrostatic latent image;

developing means for developing said electrostatic latent image and for providing a quantity of toner to form a toner image;

transfer means for transferring said toner image, formed by said developing means, to a transfer member;

different portions of said toner remaining on said photosensitive body after said transfer means transfers said toner image, respectively having one of a positive and a negative charge;

a plurality of charging means for charging said photosensitive body to a predetermined charging potential that is required for a next exposure by said exposing means, said plurality of charging means being arranged between said transfer means and said exposing means, and said plurality of charging means being arranged in said given direction of rotation of said photosensitive body, so as to charge said portions of said toner remaining on said photosensitive body after said transfer means transfers said toner image, said plurality of charging means being in direct contact with said surface of said photosensitive body to prevent a formation of ozone;

first voltage applying means coupled to at least one of said plurality of charging means, for applying a first direct voltage to said photosensitive body, said first direct voltage having a polarity that is opposite to a charging polarity of said photosensitive body;

second voltage applying means coupled to at least another one of said plurality of charging means, for applying a second direct voltage to said photosensitive body, said second direct voltage having a polarity that corresponds in polarity to said charging polarity of said photosensitive body;

said plurality of charging means further including first and second charging means;

said second charging means being positioned after said first charging means when viewed in said given direction of rotation of said photosensitive body;

said first voltage applying means applying said first direct voltage, having said polarity that is opposite to said charging polarity of said photosensitive body, to said first charging means;

said second voltage applying means applying said second direct voltage, having said polarity that corresponds in polarity to said charging polarity of said photosensitive body, to said second charging means;

said first voltage applying means applying a direct voltage value of substantially +500V to said first charging means; and said second voltage applying means applying a direct voltage value of substantially −1100V to said second charging means.

2. The electrophotographic apparatus according to claim 1, wherein the first and second voltage applying means are included in a single direct voltage supply source.

3. The electrophotographic apparatus according to claim 1, wherein said plurality of charging means comprises a plurality of conductive brushes.

4. The electrophotographic apparatus according to claim 3, wherein the first and second voltage applying means are included in a single direct voltage supply source.

5. An electrophotographic apparatus without a cleaning apparatus for cleaning used toner from a rotatable photosensitive body which is rotatable in a given direction, comprising:

exposing means for exposing and attenuating part of a charge on a surface of said photosensitive body, to form an electrostatic latent image;

developing means for developing said electrostatic latent image and for providing a quantity of toner to form a toner image;

transfer means for transferring said toner image, formed by said developing means, to a transfer member;

different portions of said toner remaining on said photosensitive body after said transfer means transfers said toner image, respectively having one of a positive and a negative charge;

a plurality of charging means for charging said photosensitive body to a predetermined charging potential that is required for a next exposure by said exposing means, said plurality of charging means being arranged between said transfer means and said exposing means, and said plurality of charging means being arranged in said given direction of rotation of said photosensitive body, so as to charge said portions of said toner remaining on said photosensitive body after said transfer means transfers said toner image, said plurality of charging means being in direct contact with said surface of said photosensitive body to prevent a formation of ozone;

first voltage applying means coupled to at least one of said plurality of charging means, for applying a first direct voltage to said photosensitive body, said first direct voltage having a polarity that is opposite to a charging polarity of said photosensitive body;

second voltage applying means coupled to at least another one of said plurality of charging means, for applying a second direct voltage to said photosensitive body, said second direct voltage having a polarity that corresponds in polarity to said charging polarity of said photosensitive body;

said plurality of charging means further including first, second, third and fourth charging means;

said first, second, third and fourth charging means being arranged in a numerically ascending sequence in said given direction of rotation of said photosensitive body, said first direct voltage having said polarity that is opposite in polarity to said charging polarity of said photosensitive body, being applied to said first and third charging means; and said second direct voltage, having said polarity that corresponds in polarity to said charging polarity of said photosensitive body, being applied to said second and fourth charging means.

6. The electrophotographic apparatus according to claim 5, wherein:

said first direct voltage applied to said first charging means has a voltage value of substantially +500V;

said second direct voltage applied to said second charging means has a voltage value of substantially −1100V.

7. The electrophotographic apparatus according to claim 6, wherein said first and second voltage applying means are included in a single direct voltage supply source, thereby enabling a miniaturization of said single direct voltage supply source.

8. The electrophotographic apparatus according to claim 7, wherein said third and fourth direct voltages are provided by said single direct voltage supply source.

9. The electrophotographic apparatus according to claim 5, wherein said plurality of charging means comprises a plurality of conductive brushes.

10. The electrophotographic apparatus according to claim 9, wherein said first and second voltage applying means are included in a single direct voltage supply source, thereby enabling a miniaturization of said single direct voltage supply source.

11. An electrophotographic apparatus without a cleaning apparatus for cleaning used toner from a rotatable photosensitive body which is rotatable in a given direction, comprising:

exposing means for exposing and attenuating part of a charge on a surface of said photosensitive body, to form an electrostatic latent image;

developing means for developing said electrostatic latent image and for providing a quantity of toner to form a toner image;

transfer means for transferring said toner image, formed by said developing means, to a transfer member;

different portions of said toner remaining on said photosensitive body after said transfer means transfers said toner image, respectively having one of a positive and a negative charge;

a plurality of charging means for charging said photosensitive body to a predetermined charging potential that is required for a next exposure by said exposure means, said plurality of charging means being arranged between said transfer means and said exposing means, and said plurality of charging means being arranged in said given direction of rotation of said photosensitive body, so as to charge said portions of said toner remaining on said photosensitive body after said transfer means transfers said toner image, said plurality of charging means being in direct contact with said surface of said photosensitive body to prevent a formation of ozone;

first voltage applying means coupled to at least one of said plurality of charging means, for applying a first direct voltage to said photosensitive body, said first direct voltage having a polarity that is opposite to a charging polarity of said photosensitive body; and second voltage applying means coupled to at least another one of said plurality of charging means, for applying a second direct voltage to said photosensitive body, said second direct voltage having a polarity that corresponds in polarity to said charging polarity of said photosensitive body; and wherein the first and second voltage applying means are included in a single direct voltage supply source, thereby enabling a miniaturization of said single direct voltage supply source.

12. The electrophotographic apparatus according to claim 11, wherein said plurality of charging means further includes first and second charging means;

said second charging means is positioned after said first charging means when viewed in said given direction of rotation of said photosensitive body;

said first voltage applying means applies said first direct voltage, having said polarity that is opposite to said charging polarity of said photosensitive body, to said first charging means; and said second voltage applying means applies said second direct voltage, having said polarity that corresponds in polarity to said charging polarity of said photosensitive body, to said second charging means.

13. The electrophotographic apparatus according to claim 12, wherein:

said first direct voltage having a voltage value of substantially +500V is applied to said first charging means;

said second direct voltage having a voltage value of substantially −1100V is applied to said second charging means;

a third direct voltage having a voltage value of from 0 to +10V is applied to a third charging means; and a fourth direct voltage having a voltage value of substantially −1100V is applied to a fourth charging means.

14. The electrophotographic apparatus according to claim 13, wherein said third and fourth direct voltages are also provided by said single direct voltage supply source.

15. The electrophotographic apparatus according to claim 11, wherein said plurality of charging means comprises a plurality of conductive brushes.

16. An electrophotographic apparatus without a cleaning apparatus for cleaning used toner from a rotatable photosensitive body which is rotatable in a given direction, comprising:

exposing means for exposing and attenuating part of a charge on a surface of said photosensitive body, to form an electrostatic latent image;

developing means for developing said electrostatic latent image and for providing a quantity of toner for said electrostatic latent image, to form a toner image;

transfer means for transferring said toner image, formed by said developing means, to a transfer member;

a plurality of charging means, including a first charging means and a second charging means, for charging said photosensitive body, said plurality of charging means being arranged in a given direction of rotation of said photosensitive body, said plurality of charging means being positioned when viewed in said given direction of rotation after said transfer means and before said exposing means, said plurality of charging means being in direct contact with said surface of said photosensitive body, said second charging means being positioned after said first charging means when viewed in said given direction of rotation of said photosensitive body;

first voltage applying means for applying a first direct voltage to said first charging means, said first direct voltage having a polarity that is opposite to a charging polarity of said photosensitive body, and said first direct voltage being substantially equal to a charge starting voltage potential; and second voltage applying means for applying a second direct voltage to said second charging means, said second direct voltage having a polarity that corresponds in polarity to said charging polarity of said photosensitive body, and said second direct voltage causing said surface of said photosensitive body to have a predetermined charging potential.

17. The electrophotographic apparatus according to claim 16, wherein:

said first direct voltage having a voltage value of substantially +500V is applied to said first charging means;

said second direct voltage having a voltage value of substantially −1100V is applied to said second charging means;

a third direct voltage having a voltage value of from 0 to +10V is applied to a third charging means; and a fourth direct voltage having a voltage value of substantially −1100V is applied to a fourth charging means.

18. The electrophotographic apparatus according to claim 17, wherein said first, second, third and fourth direct voltages are provided by a single direct voltages supply source.

19. The electrophotographic apparatus according to claim 16, wherein said first and second voltage applying means are included in a single direct voltage supply source.

20. The electrophotographic apparatus according to claim 16, wherein said plurality of charging means comprises a plurality of conductive brushes.

21. The electrophotographic apparatus according to claim 16, wherein:

said first voltage applying means applying a direct voltage value of substantially +500V to said first charging means; and said second voltage applying means applying a direct voltage value of substantially −1100V to said second charging means.

22. The electrophotographic apparatus according to claim 16, wherein:

said plurality of charging means including first, second, third, and fourth charging means, arranged in a numerically ascending sequence in said given direction of rotation of said photosensitive body, said first direct voltage having said polarity that is opposite in polarity to said charging polarity of said photosensitive body, being applied to said first and third charging means; and said second direct voltage, having said polarity that corresponds in polarity to said charging polarity of said photosensitive body, being applied to said second and fourth charging means.

23. The electrophotographic apparatus according to claim 22, wherein:

said first direct voltage having a voltage value of substantially +500V is applied to said first charging means;

said second direct voltage having a voltage value of substantially −1100V is applied to said second charging means;

a third direct voltage having a voltage value of from 0 to +10V is applied to said third charging means; and a fourth direct voltage having a voltage value of substantially −1100V is applied to said fourth charging means.

24. The electrophotographic apparatus according to claim 23, wherein the first and second voltage applying means are included in a single direct voltage supply source, thereby enabling a miniaturization of said single direct voltage supply source.

25. The electrophotographic apparatus according to claim 23, wherein said plurality of charging means comprises a plurality of conductive brushes.

26. The electrophotographic apparatus according to claim 16, wherein the first and second voltage applying means are included in a single direct voltage supply source, thereby enabling a miniaturization of said single direct voltage supply source.

* * * * *